US009752817B2

(12) United States Patent
Richards et al.

(10) Patent No.: US 9,752,817 B2
(45) Date of Patent: Sep. 5, 2017

(54) DOOR/DRAWER PANEL ADJUSTMENT MECHANISM FOR AN APPLIANCE

(71) Applicant: WHIRLPOOL CORPORATION, Benton Harbor, MI (US)

(72) Inventors: Michael S. Richards, St. Joseph, MI (US); Rahul Wadke, St. Joseph, MI (US); Joshua J. Wittes, Berrien Springs, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 16 days.

(21) Appl. No.: 14/973,952

(22) Filed: Dec. 18, 2015

(65) Prior Publication Data

US 2017/0176088 A1 Jun. 22, 2017

(51) Int. Cl.

| | |
|---|---|
| ***A47B 96/04*** | (2006.01) |
| ***A47B 88/00*** | (2017.01) |
| ***F25D 23/02*** | (2006.01) |
| ***F25D 25/02*** | (2006.01) |
| ***A47B 88/956*** | (2017.01) |

(52) U.S. Cl.

CPC ..... *F25D 23/028* (2013.01); *A47B 88/956* (2017.01); *F25D 25/025* (2013.01); *F25D 2323/024* (2013.01); *F25D 2500/02* (2013.01)

(58) Field of Classification Search

CPC ..... F25D 25/025; F25D 2323/024; F25D 2500/02; F25D 23/028

USPC ..... 312/402, 404, 405, 348.1

See application file for complete search history.

(56) References Cited

U.S. PATENT DOCUMENTS

| | | | | |
|---|---|---|---|---|
| 2,839,778 | A * | 6/1958 | Hutchinson | E05D 7/0423 16/245 |
| 4,090,753 | A | 5/1978 | Rock et al. | |
| 4,589,710 | A * | 5/1986 | Rock | A47B 88/0055 248/188.2 |
| 4,595,245 | A * | 6/1986 | Rock | A47B 88/0055 248/188.2 |
| 4,690,469 | A | 9/1987 | Grass | |
| 4,705,328 | A * | 11/1987 | Rock | A47B 88/0055 312/263 |
| 4,815,798 | A * | 3/1989 | Rock | A47B 88/0051 312/263 |
| 5,147,124 | A | 9/1992 | Grass et al. | |

(Continued)

*Primary Examiner* — Daniel J Troy
*Assistant Examiner* — Timothy M Ayres
(74) *Attorney, Agent, or Firm* — Price Heneveld LLP

(57) ABSTRACT

A panel adjustment mechanism for an appliance includes an adjustment bracket having a first lateral adjustment mechanism extending from a first side of the adjustment bracket. A vertical adjustment mechanism extends from a second side of the adjustment bracket. A door panel abutment surface is positioned perpendicular to the first and second sides of the panel adjustment bracket. A bracket housing defines an adjustment region and includes first and second flanges, wherein the first lateral adjustment mechanism extends through a lateral adjustment slot defined in the first flange, wherein the vertical adjustment mechanism extends through a vertical adjustment slot defined within the second flange, wherein the operation of at least one of the lateral adjustment mechanism and the vertical adjustment mechanism moves the panel adjustment bracket between a plurality of positions within the adjustment region.

18 Claims, 12 Drawing Sheets

(56) References Cited

U.S. PATENT DOCUMENTS 6,079,164 A * 6/2000 Lanzani ..... A47L 15/4251 248/316.1
6,390,576 B1 5/2002 Walburn
6,447,083 B1 9/2002 Chiapetta et al.
6,681,446 B2 * 1/2004 Compagnucci ..... A47B 96/06 16/236
6,742,352 B2 6/2004 Kampf
6,742,353 B2 6/2004 Ohashi et al.
7,475,562 B2 1/2009 Jackovin
8,215,730 B2 7/2012 Brown et al.
8,231,190 B2 7/2012 Ertz et al.
8,328,301 B2 12/2012 Lee et al.
8,382,219 B2 2/2013 Hottmann et al.
8,408,663 B2 4/2013 Chellappan et al.
8,474,928 B2 7/2013 Ertz et al.
8,506,026 B2 * 8/2013 Kim ..... F25D 23/028 312/405
8,511,767 B2 8/2013 Haidar et al.
8,651,590 B2 * 2/2014 Wilson ..... F25D 23/10 312/204
8,783,800 B2 7/2014 Benigni
8,789,902 B2 7/2014 Hottmann et al.
8,875,538 B2 11/2014 Lee et al.
8,939,526 B1 * 1/2015 Chambers ..... A47B 77/18 312/348.4
8,955,352 B2 2/2015 Lee et al.
9,039,110 B2 5/2015 Haltmeyer et al.
9,074,810 B2 7/2015 Hwang et al.
9,101,211 B2 * 8/2015 Cabal Velarde ... A47B 88/0055
9,175,896 B2 11/2015 Choi
9,185,976 B2 * 11/2015 Chen ..... A47B 88/0055
9,303,916 B2 * 4/2016 Ozyuksel ..... F25D 23/10
2004/0222725 A1 * 11/2004 Park ..... A47B 77/08 312/405
2005/0093407 A1 * 5/2005 Feeley ..... A47B 88/0055 312/348.4
2007/0113377 A1 * 5/2007 Brachert ..... E05D 7/04 16/247
2008/0074019 A1 * 3/2008 Park ..... A47B 88/0055 312/236
2009/0167130 A1 7/2009 Chellappan et al.
2010/0090575 A1 4/2010 Uthuppan
2010/0320890 A1 12/2010 Jung et al.
2011/0146325 A1 6/2011 Lee
2011/0309732 A1 12/2011 Horil et al.
2012/0091874 A1 4/2012 Lee et al.
2012/0099255 A1 4/2012 Lee et al.
2014/0097733 A1 4/2014 Seo et al.
2014/0306592 A1 10/2014 Hottmann et al.
2015/0184928 A1 * 7/2015 Ozyuksel ..... F25D 23/10 312/326

* cited by examiner

DOOR/DRAWER PANEL ADJUSTMENT MECHANISM FOR AN APPLIANCE

BACKGROUND

The device is in the field of household appliances having operable panels, and more specifically, an adjustment mechanism for positioning door/drawer panels in an aligned position with respect to the appliance.

SUMMARY

In at least one aspect, a refrigerated appliance includes an appliance cabinet defining at least one interior compartment, a drawer having a drawer panel coupled to the appliance cabinet and slidably operable between a closed position, wherein the drawer panel engages a surface of the appliance cabinet and an open position. A panel adjustment mechanism is coupled to the drawer panel, wherein the panel adjustment mechanism positions the drawer panel in an aligned position relative to the appliance cabinet. The adjustment mechanism includes a panel adjustment bracket having a first lateral adjustment mechanism extending from a first side of the panel adjustment bracket, a vertical adjustment mechanism extending from a second side of the panel adjustment bracket and a drawer panel abutment surface. The drawer panel abutment surface is positioned perpendicular to the first and second sides of the panel adjustment bracket and is in engagement with the drawer panel. A bracket housing has first and second flanges that at least partially define an adjustment region. The first lateral adjustment mechanism extends through the first flange and the vertical adjustment mechanism extends through the second flange. Operation of at least one of the first lateral adjustment mechanism and the vertical adjustment mechanism moves the panel adjustment bracket between a plurality of positions within the adjustment region.

In at least another aspect, an appliance includes an appliance cabinet defining at least one interior compartment, a door panel coupled to the appliance cabinet and operable between open and closed positions and a panel adjustment mechanism coupled to the door panel. The panel adjustment mechanism operates to position the door panel in an aligned position relative to the appliance cabinet. The adjustment mechanism includes an adjustment bracket engaged with the door panel and having a plurality of directional adjustment mechanisms, and wherein the adjustment bracket includes a door panel engagement surface that receives the door panel. A bracket housing is engaged with the appliance cabinet and defines an adjustment region that receives the adjustment bracket. The plurality of directional adjustment mechanisms of the adjustment bracket engage the bracket housing. Operation of at least one of the plurality of directional adjustment mechanisms operates the adjustment bracket within the bracket housing to position the door panel engagement surface and the door panel in the aligned position.

In at least another aspect, a panel adjustment mechanism for a kitchen appliance includes a panel adjustment bracket having a first lateral adjustment mechanism extending from a first side of the panel adjustment bracket. A vertical adjustment mechanism extends from a second side of the panel adjustment bracket. A door panel abutment surface is positioned perpendicular to the first and second sides of the panel adjustment bracket and the first side is positioned perpendicular to the second side. A bracket housing has a plurality of flanges that at least partially define an adjustment region, wherein the plurality of flanges includes first and second flanges. The first lateral adjustment mechanism extends through a lateral adjustment slot defined in the first flange. The vertical adjustment mechanism extends through a vertical adjustment slot defined within the second flange. Operation of at least one of the lateral adjustment mechanism and the vertical adjustment mechanism moves the panel adjustment bracket between a plurality of positions within the adjustment region.

These and other features, advantages, and objects of the present device will be further understood and appreciated by those skilled in the art upon studying the following specification, claims, and appended drawings.

DETAILED DESCRIPTION OF EMBODIMENTS

Figure 1:
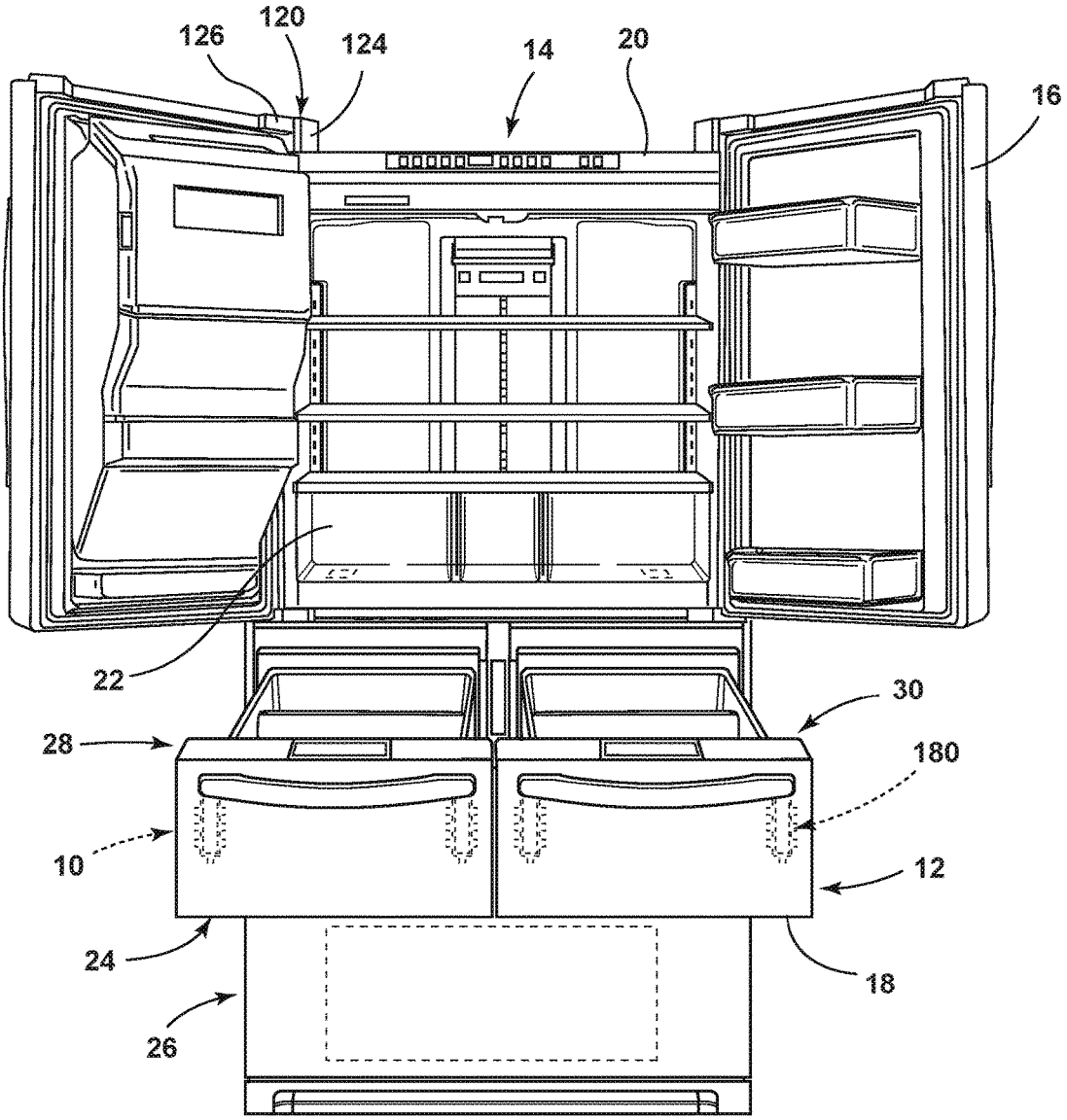
FIG. 1 is a front perspective view of an appliance incorporating an aspect of the panel adjustment mechanism incorporated therein.
Figure 2:
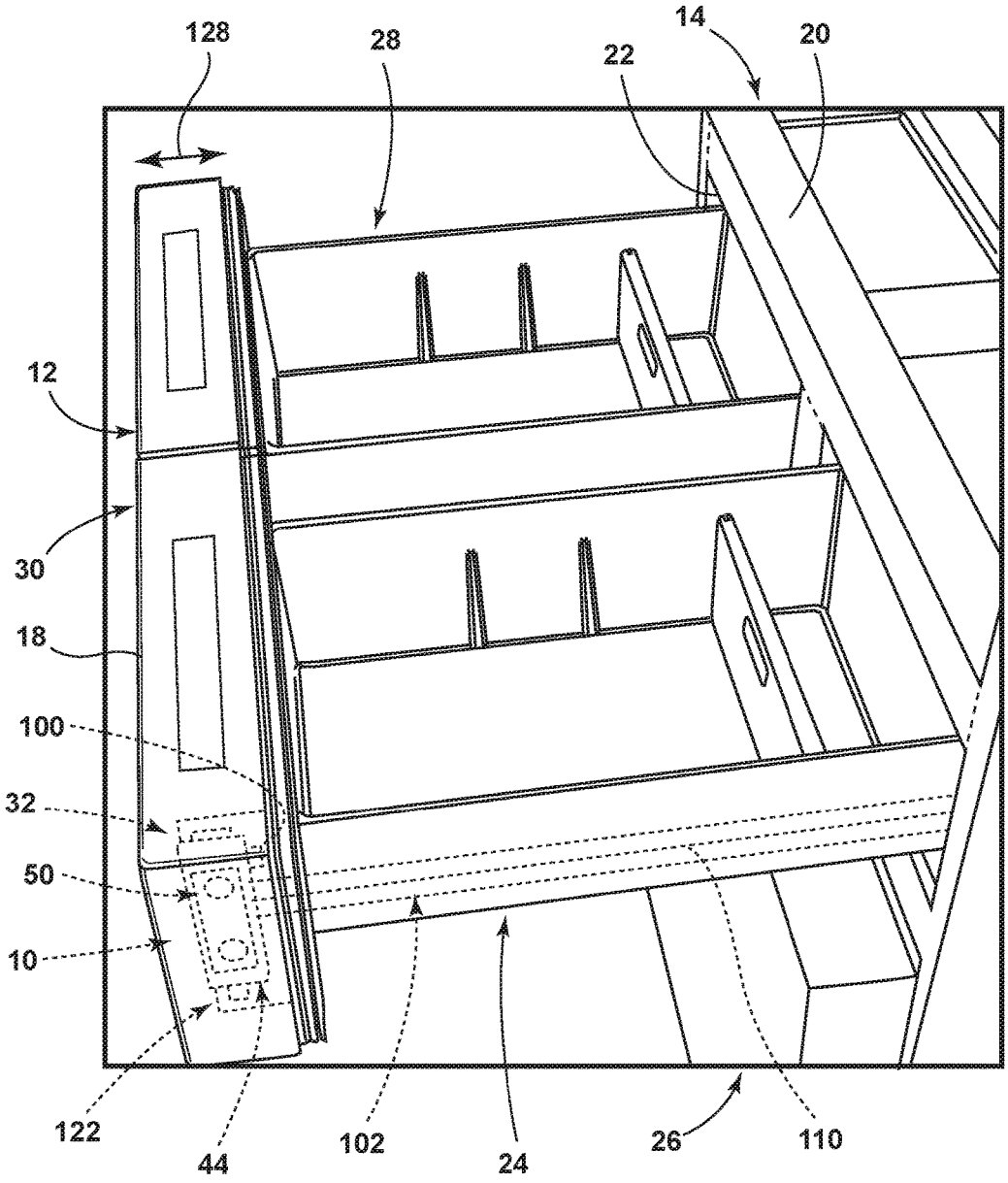
FIG. 2 is a top perspective view of the pantry compartment of an appliance, with the pantry drawers in an open position.
Figure 3:
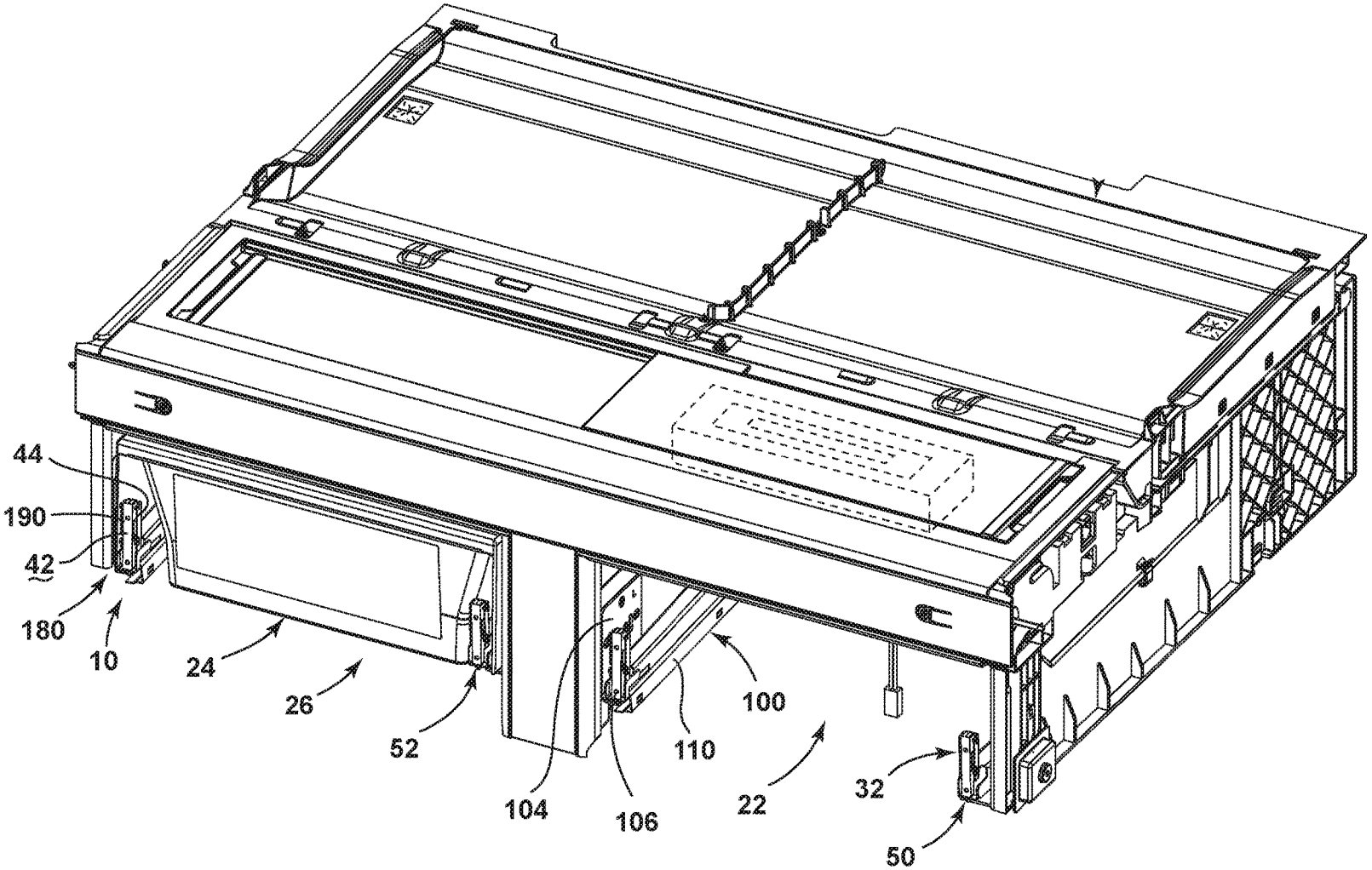
FIG. 3 is a partially exploded top perspective view of a pantry compartment removed from an appliance and illustrating an aspect of the panel adjustment mechanism.
Figure 4:
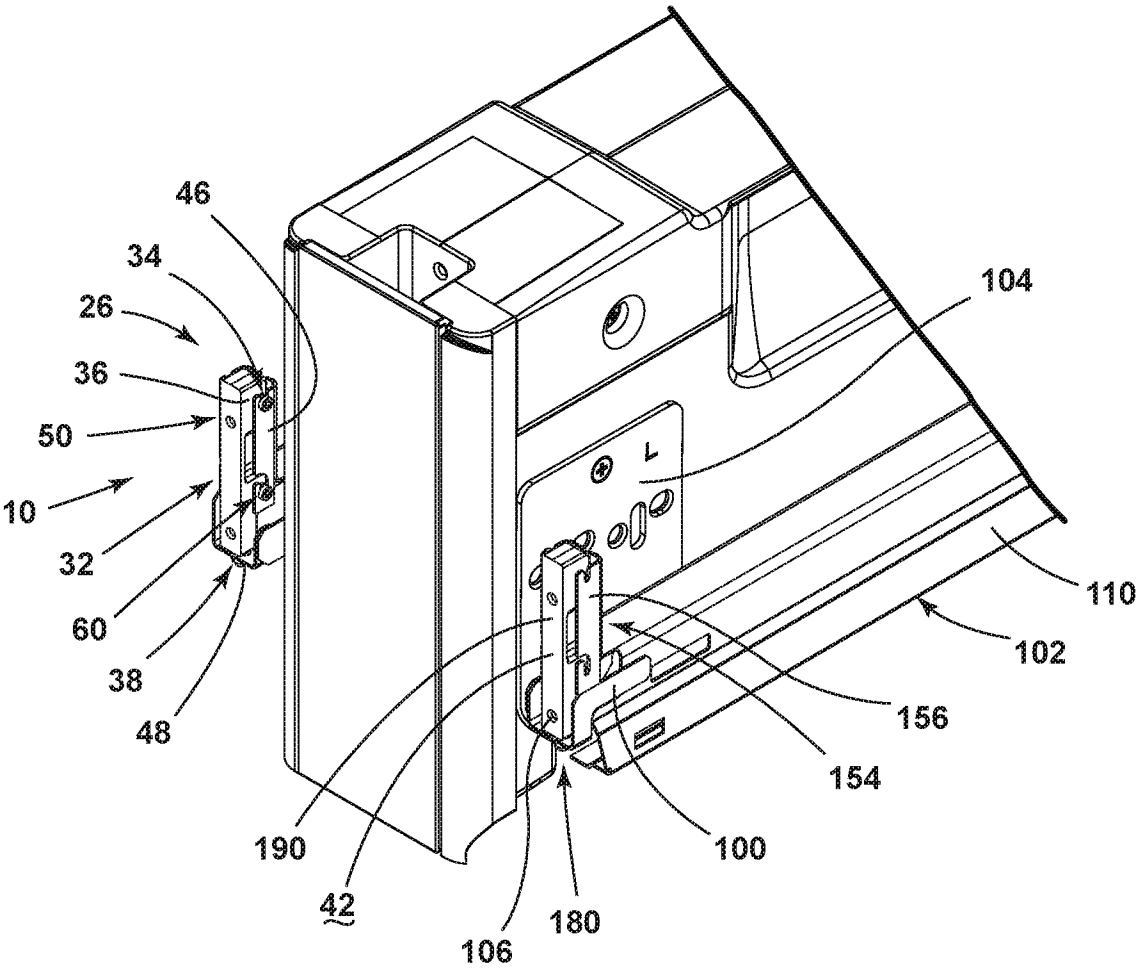
FIG. 4 is an enlarged perspective view of an aspect of the panel adjustment mechanism for aligning the various door/drawer panels of an appliance.
Figure 5:
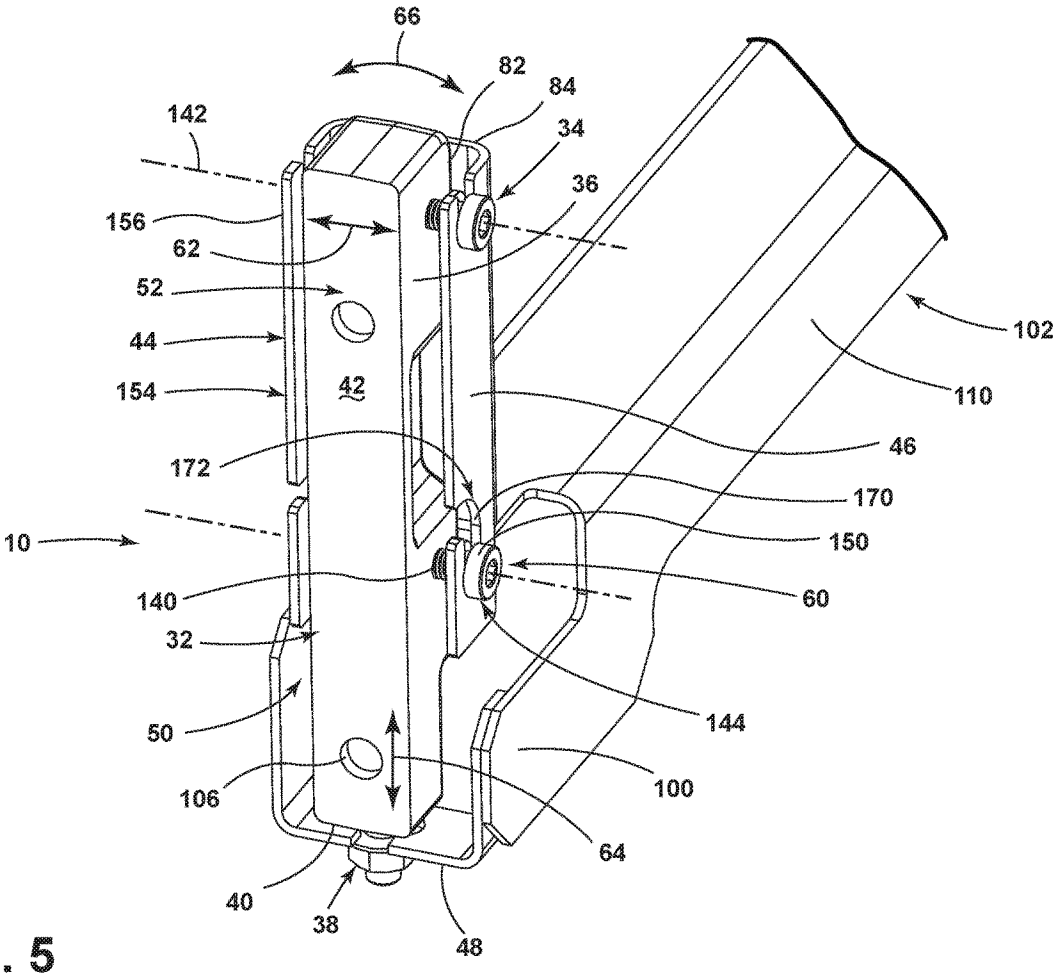
FIG. 5 is a front perspective view of an aspect of the panel adjustment mechanism.
Figure 6:
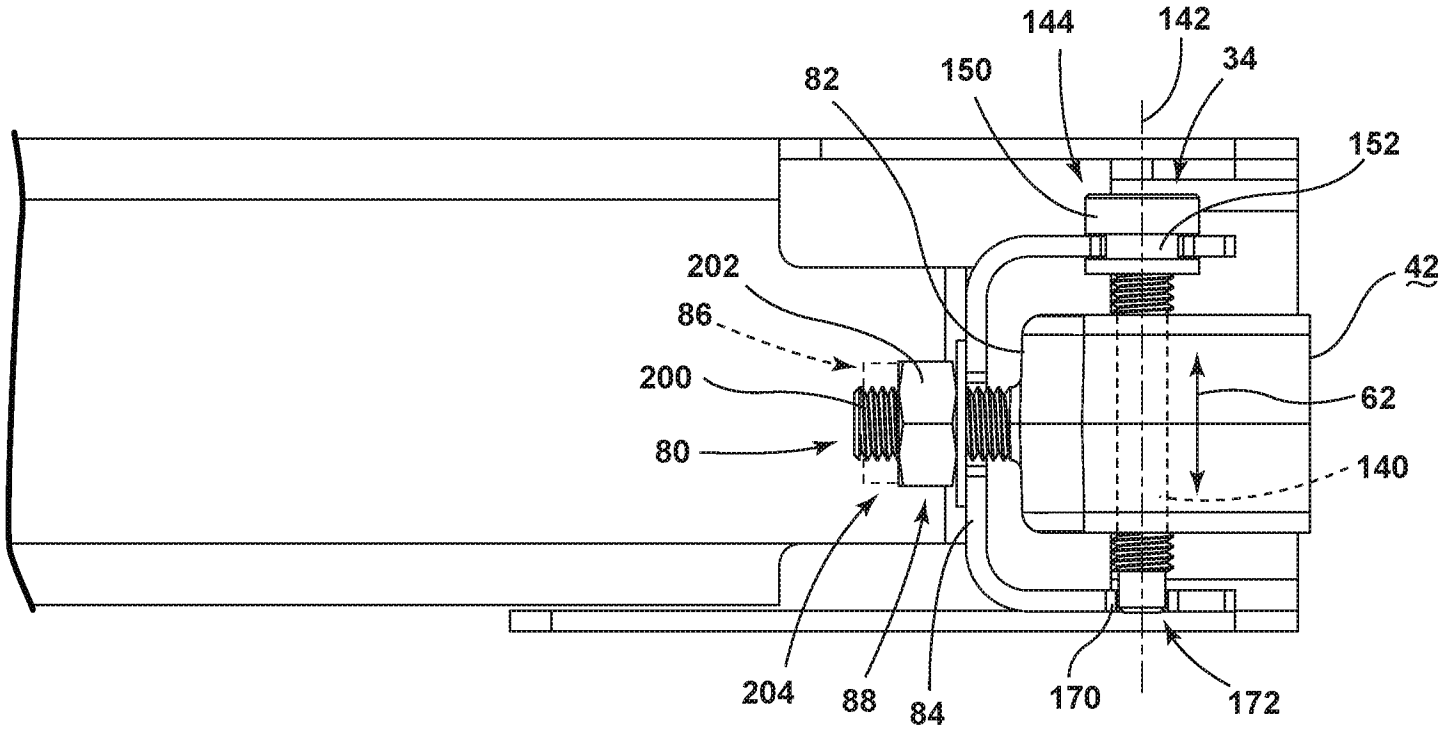
FIG. 6 is a top plan view of the panel adjustment mechanism of FIG. 5.
Figure 7:
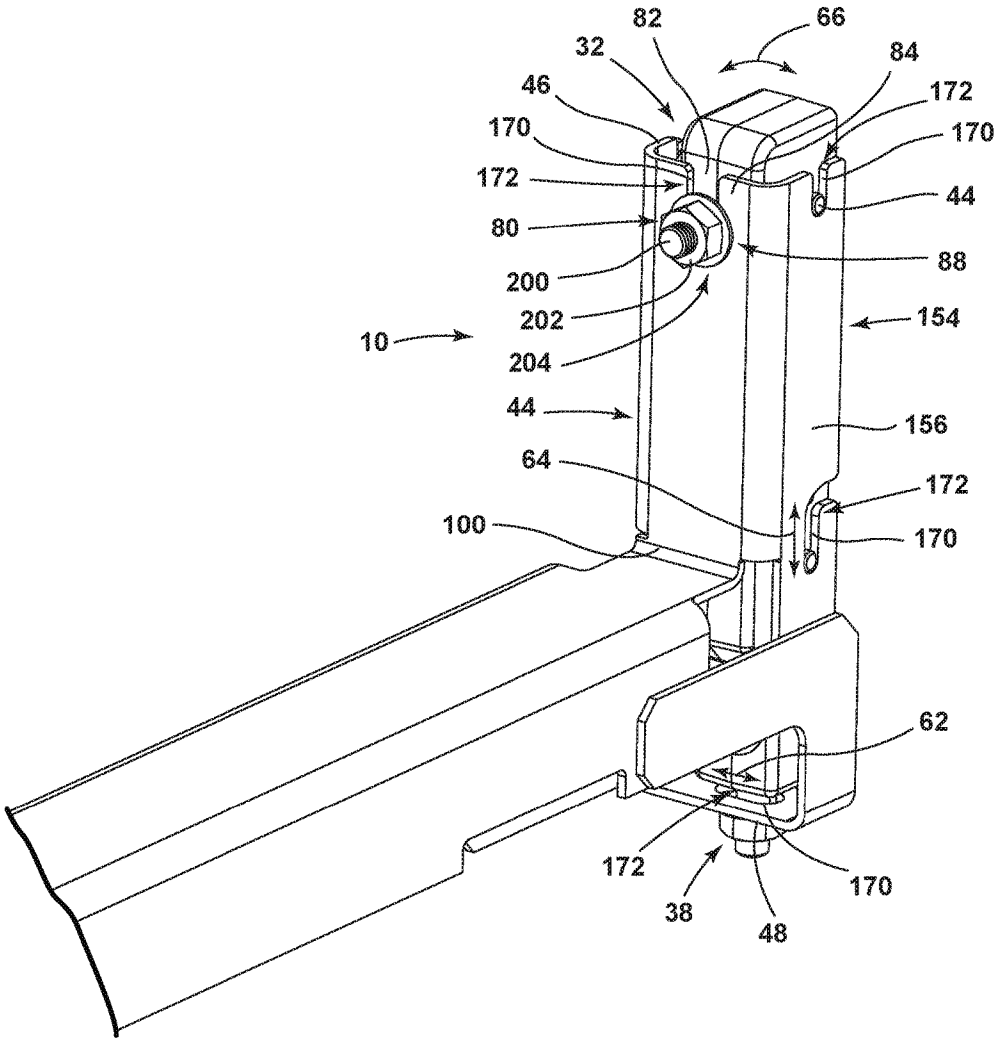
FIG. 7 is a rear perspective view of the panel adjustment mechanism of FIG. 5.
Figure 8:
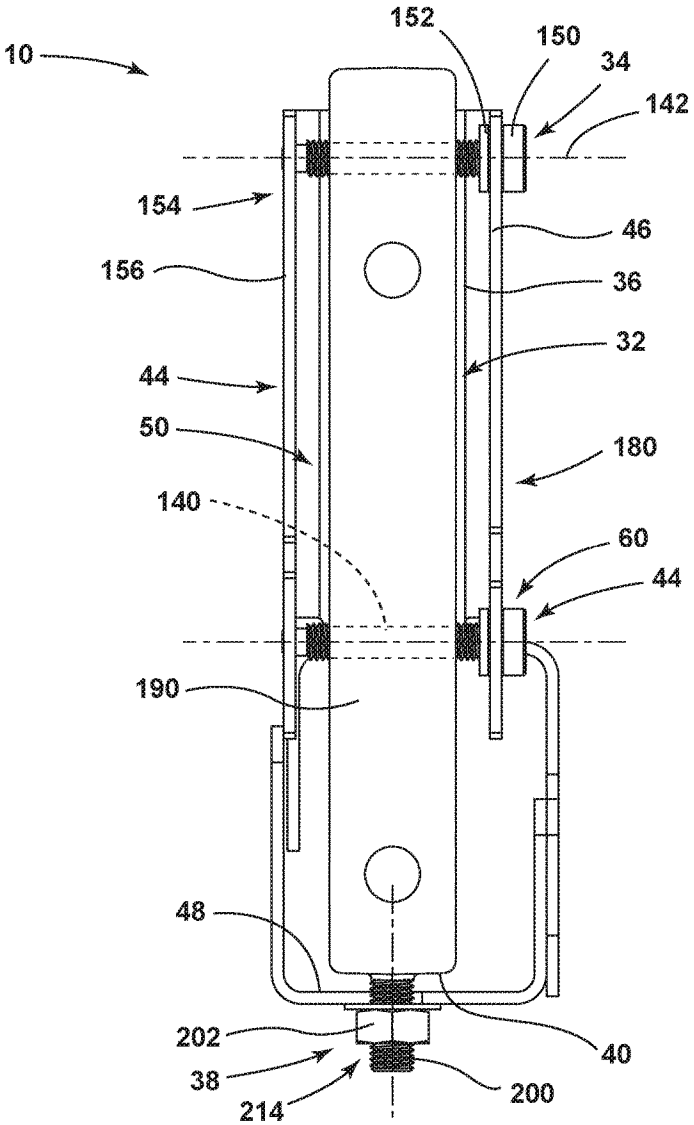
FIG. 8 is a front elevational view of the panel adjustment mechanism of FIG. 5.
Figure 9:
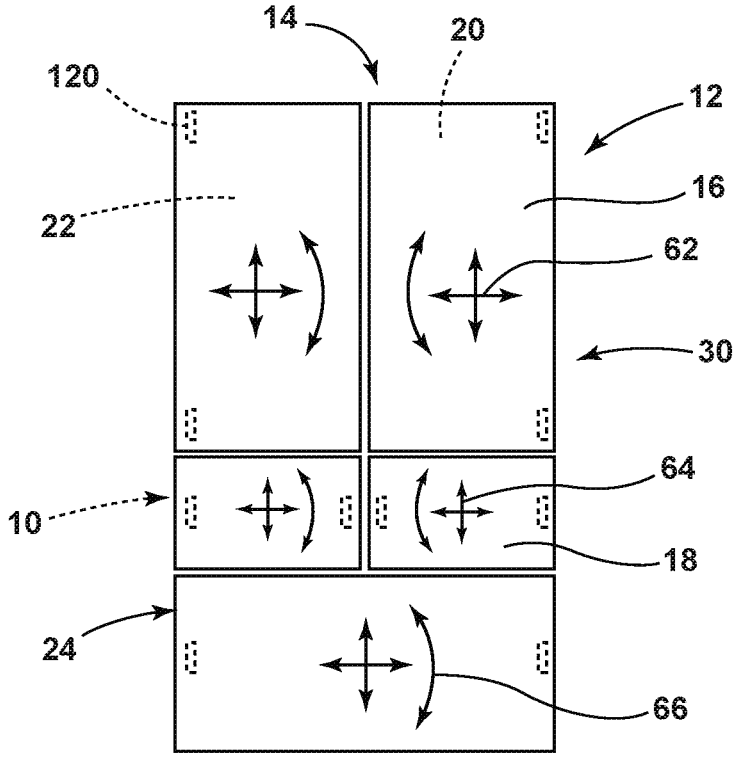
FIG. 9 is a schematic front elevational view of an appliance incorporating an aspect of the panel adjustment mechanism and illustrating the directional adjustments made through the use of the panel adjustment mechanisms of the appliance.
Figure 10:
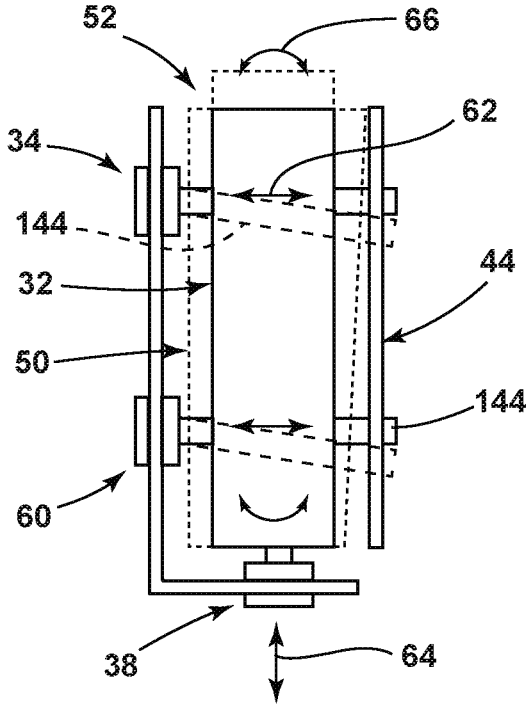
FIG. 10 is a schematic elevational view of an aspect of the panel adjustment mechanism illustrating the various movements of the panel adjustment bracket incorporated within the panel adjustment mechanism for modifying a position of the door/drawer panel of an appliance.
Figure 11:
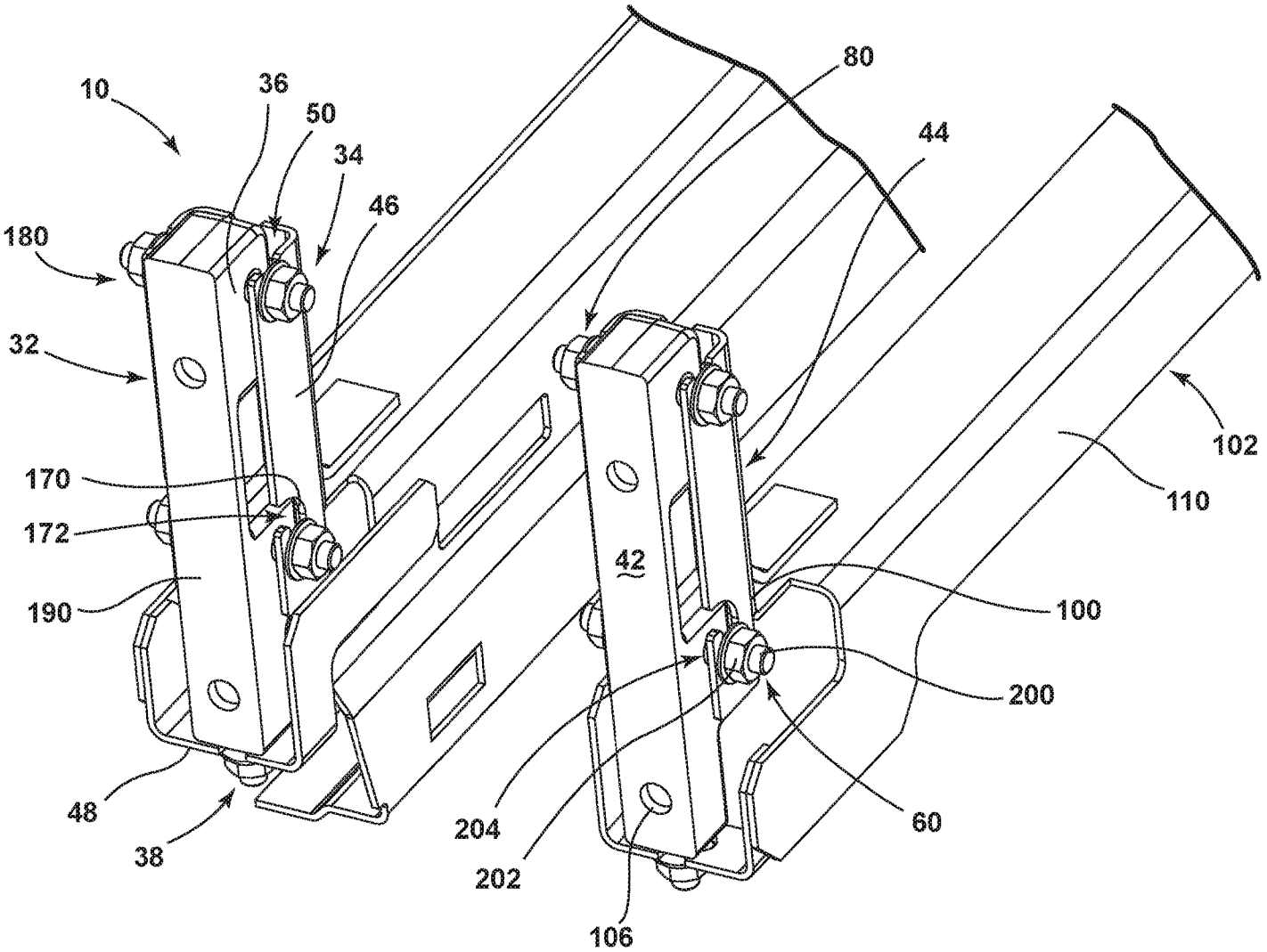
FIG. 11 is a front perspective view of an aspect of a panel adjustment mechanism for aligning the various door/drawer panels of an appliance.
Figure 12:
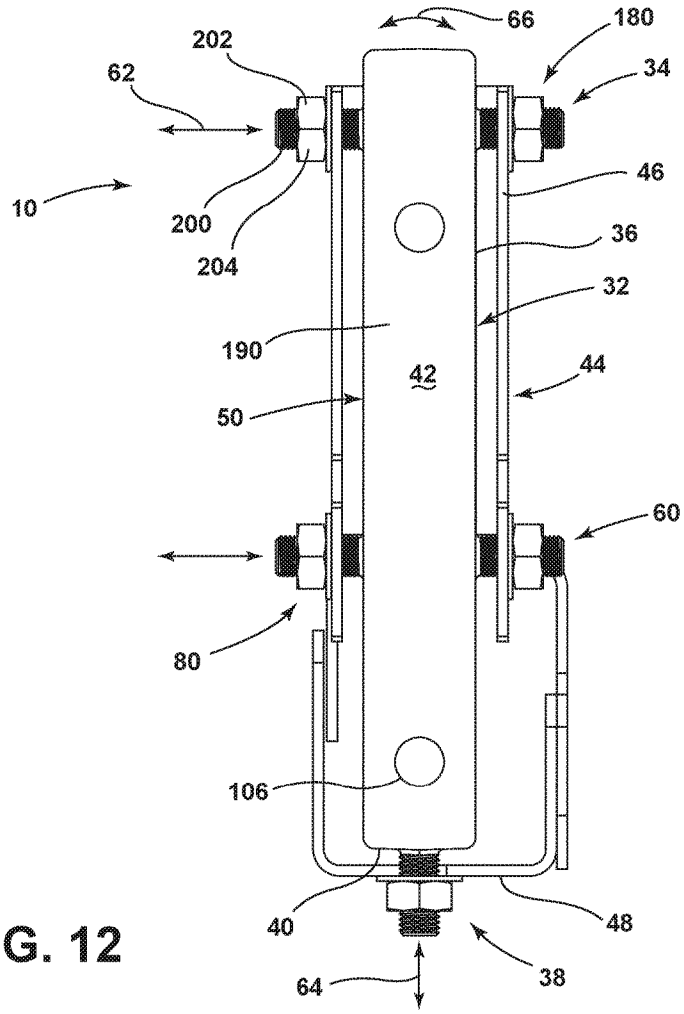
FIG. 12 is a front elevational view of an aspect of the panel adjustment mechanism.
Figure 13:
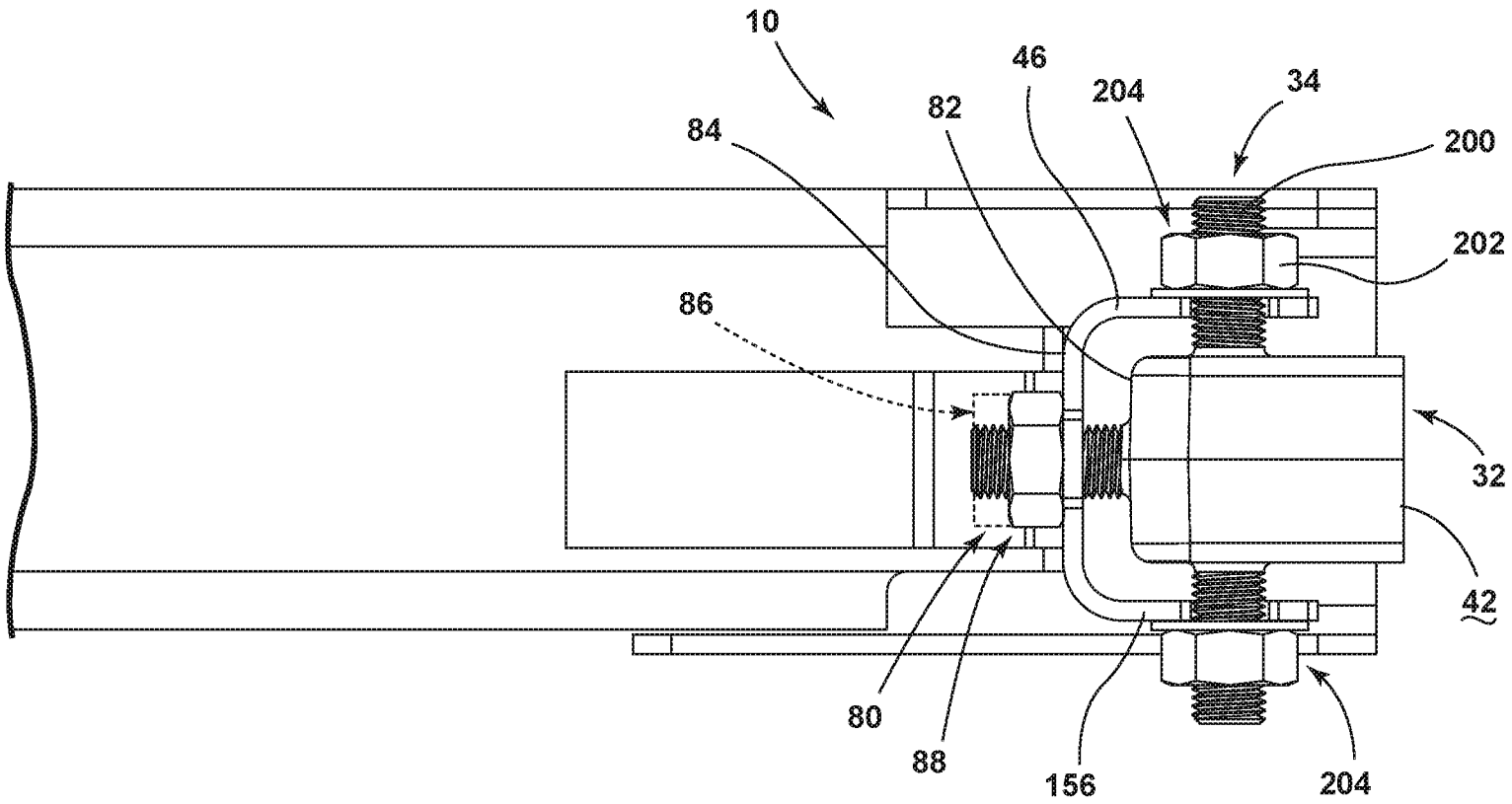
FIG. 13 is a top plan view of the panel adjustment mechanism of FIG. 10.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-10, reference numeral 10 generally refers to a panel adjustment mechanism attached to a panel member 12 of an appliance 14, such as a door panel 16 or drawer panel 18, for an appliance 14. According to the various embodiments, a refrigerated appliance 14 can include a cabinet 20 that defines at least one interior compartment 22. A drawer 24 having a drawer panel 18 is coupled to the cabinet 20 of the appliance 14 and is slidably operable between a closed position 26, wherein the drawer panel 18 engages a surface of the cabinet 20, and an open position 28, wherein the drawer 24 is extended from the interior compartment 22. The panel adjustment mechanism 10 is coupled to the drawer panel 18, wherein the panel adjustment mechanism 10 positions the drawer panel 18 in an aligned position 30 relative to the cabinet 20, as well as other drawer panels 18 and door panels 16, of the appliance 14. The panel adjustment mechanism 10 includes a panel adjustment bracket 32 having a first lateral adjustment mechanism 34 extending from a first side 36 of the panel adjustment bracket 32. A vertical adjustment mechanism 38 extends from a second side 40 of the panel adjustment bracket 32. A panel abutment surface 42 is also defined by the panel adjustment bracket 32, wherein the panel abutment surface 42 is positioned perpendicular to the first and second sides 36, 40 of the panel adjustment bracket 32 and is in engagement with the drawer panel 18 of the drawer 24 for the appliance 14. A bracket housing 44 includes first and second flanges 46, 48 that at least partially define an adjustment region 50 within which the panel adjustment bracket 32 is positioned. The first lateral adjustment mechanism 34 extends through the first flange 46 and the vertical adjustment mechanism 38 extends through the second flange 48. Operation of at least one of the first lateral adjustment mechanism 34 and the vertical adjustment mechanism 38 serves to move the panel adjustment bracket 32 between a plurality of positions 52 within the adjustment region 50.

Referring again to FIGS. 1-10, it is also contemplated that a second lateral adjustment mechanism 60 can be positioned substantially parallel to the first lateral adjustment mechanism 34 or parallel with the first lateral adjustment mechanism 34. In such an embodiment, the first and second lateral adjustment mechanisms 34, 60 cooperate to laterally adjust the panel adjustment bracket 32 between the plurality of positions 52 within the adjustment region 50 defined by the bracket housing 44. The plurality of positions 52 can be defined by lateral adjustment 62 and vertical adjustment 64 of the panel adjustment bracket 32 within the adjustment region 50 of the bracket housing 44. Operation of the first and second lateral adjustment mechanisms 34, 60 can also result in rotational adjustment 66 of the panel adjustment bracket 32 within the bracket housing 44, typically along a single plane.

According to the various embodiments, as exemplified in FIGS. 4-10, operation of the vertical adjustment mechanism 38 operates the panel adjustment bracket 32 for vertical adjustment 64 within the adjustment region 50. In this manner, operation of the vertical adjustment mechanism 38 also moves the door panel 16 or drawer panel 18 to which the panel adjustment bracket 32 is attached, such that minute vertical adjustments 64 can be made to the positioning of the door panel 16 or drawer panel 18 to define the aligned position 30 of the various door panels 16 and drawer panels 18 of the appliance 14. Similarly, adjustment of the first and second lateral adjustment mechanisms 34, 60 can move the panel adjustment bracket 32 for lateral adjustment 62 within the adjustment region 50 and, in turn, move the door panel 16 or drawer panel 18 in a lateral direction to define the aligned position 30 relative to the cabinet 20 of the appliance 14 and the other door panels 16 and drawer panels 18 of the appliance 14.

As exemplified in FIGS. 5-10, operation of one of the first and second lateral adjustment mechanisms 34, 60 or independent and different adjustment of the first and second lateral adjustment mechanisms 34, 60 can provide for rotational adjustment 66 of the panel adjustment bracket 32 within the adjustment region 50. In this manner, rotational adjustment 66 of the door panel 16 or drawer panel 18 attached to the panel adjustment bracket 32 at the panel abutment surface 42 can serve to rotationally adjust the door panel 16 or drawer panel 18 relative to the cabinet 20 of the appliance 14 and the remaining drawer panels 18 and door panels 16 of the appliance 14.

Referring again to FIGS. 4-10, it is contemplated that the panel adjustment bracket 32 can include a locking mechanism 80 that extends from the third side 82 of a panel adjustment bracket 32. In such an embodiment, the third side 82 of the panel adjustment bracket 32 is oriented perpendicular or substantially perpendicular to the first and second sides 36, 40 of the panel adjustment bracket 32. The locking mechanism 80 is configured to engage a third flange 84 of the bracket housing 44 that is substantially parallel with a third side 82 of the panel adjustment bracket 32. It is contemplated that the third flange 84 of the bracket housing 44 also defines the adjustment region 50 within which the panel adjustment bracket 32 is adjusted. The locking mechanism 80 of the panel adjustment bracket 32 is operable between an adjustment position 86, wherein the position of the panel adjustment bracket 32 is adjustable through operation of the vertical adjustment mechanism 38 and the first lateral adjustment mechanism 34 and the second lateral adjustment mechanism 60. The locking mechanism 80 is also operable to a locked position 88, wherein the vertical and first and second lateral adjustment mechanisms 34, 60 are substantially inoperable. Accordingly, the use of the locking mechanism 80 can serve to secure the position of the panel adjustment bracket 32 within the adjustment region 50 of the bracket housing 44. After finite adjustment to any one or more of the first and second lateral adjustment mechanisms 34, 60 and the vertical adjustment mechanism 38 is completed, the locking mechanism 80 can be placed in the locked position 88 to secure the panel adjustment bracket 32 within the adjustment region 50 of the bracket housing 44. This, in turn, secures the respective door panel 16 or drawer panel 18 in the aligned position 30 relative to the cabinet 20 and the other door panels 16 and drawer panels 18 of the appliance 14.

Referring again to the various embodiments exemplified in FIGS. 1-13, it is contemplated that the various aspects of the panel adjustment mechanism 10 can be disposed at ends 100 of respective drawer glides 102 for a drawer 24 of the appliance 14. In such an embodiment, the drawer panel 18 can include two separate panel adjustment mechanisms 10 on each side of the drawer panel 18 and disposed at the ends 100 of the respective drawer glides 102 for the drawer 24. During installation of the drawer panel 18 and the drawer 24, the panel adjustment mechanisms 10 can be individually operated to align each of the sides of the drawer panel 18 to place the drawer panel 18 in the aligned position 30 relative to the cabinet 20 of the appliance 14 and the other drawer panels 18 and door panels 16 of the appliance 14.

According to the various embodiments, as exemplified in FIGS. 1-13, where the panel adjustment mechanisms 10 are disposed at the ends 100 of the drawer glides 102, each of the drawer glides 102 can include a cabinet engagement flange 104 that is coupled to the bracket housing 44. The bracket housing 44, as discussed above, is, in turn, attached to the end 100 of each drawer glide 102. In this manner, the bracket housing 44, through its engagement with the drawer glide 102, is operable to extend and retract from the interior compartment 22 of the appliance 14. The cabinet engagement flange 104 is attached to the cabinet 20 of the appliance 14 and serves to attach the drawer glide 102 to the cabinet 20 of the appliance 14. Through this engagement, the panel adjustment bracket 32 and the bracket housing 44 are able to linearly and slidably operate via the drawer glide 102 relative to the cabinet engagement flange 104. In this manner, the drawer panel 18, through its engagement with the panel abutment surface 42, is operable between the open and closed position 28, 26 through the slidable operation of each of the drawer glides 102 for the drawer 24. The panel abutment surface 42 can include one or more receptacles 106 within which a portion of the drawer panel 18 can be retained and, in some embodiments, adjusted.

Referring again to FIGS. 1-13, the cabinet engagement flange 104 of the drawer glide 102 serves as a static member of the drawer glide 102 that is attached to the cabinet 20. Each of the drawer glides 102 can also include a sliding member 110 that slidably operates relative to the cabinet engagement flange 104. An end 100 of the sliding member 110 of the drawer glide 102 is configured to attach proximate, and in some embodiments, directly, to the bracket housing 44. It is also contemplated that the bracket housing 44 can be integral portion of the sliding member 110 that defines an end 100 of the drawer glide 102. In such an embodiment, an end 100 of the sliding member 110 is shaped to define at least a portion of the bracket housing 44. The panel adjustment bracket 32 is then permitted to be adjustable within the adjustment region 50 defined by the bracket housing 44. It is contemplated that large adjustments of the position of each of the drawer panel 18 and door panel 16 is accomplished through adjustment of the cabinet engagement flange 104 relative to the cabinet 20. More finite adjustment of the position of the drawer panel 18 is accomplished through adjustment of the panel adjustment bracket 32 within the bracket housing 44 to achieve the aligned position 30 of the drawer panel 18 with respect to the cabinet 20 of the appliance 14 and other door panels 16 and drawer panels 18 of the appliance 14.

Referring again to FIGS. 4-10, each of the vertical adjustment mechanism 38 and the first and second lateral adjustment mechanisms 34, 60 are defined by a threaded aperture 140 defined within the panel adjustment bracket 32. A central axis 142 extends through each threaded aperture 140 within the panel adjustment bracket 32 and a cooperating screw 144 rotationally engages the threaded aperture 140 along the respective central axis 142. The cooperating screw 144 extends through a respective flange of the bracket housing 44, corresponding to the first and second flanges 46, 48 that receive the first and second lateral adjustment mechanisms 34, 60 and the vertical adjustment mechanism 38, respectively. In this manner, each cooperating screw 144 is engaged within a respective flange, such that the cooperating screw 144 is free of lateral movement relative to the respective flange of the bracket housing 44, but is rotationally operable within the respective flange of the bracket housing 44. Accordingly, rotational operation of the cooperating screw 144 adjusts the position of the panel adjustment bracket 32 relative to the respective flange through the various lateral, vertical and rotational adjustments 62, 64, 66.

Referring again to FIGS. 5-10, each cooperating screw 144 of the first and second lateral adjustment mechanisms 34, 60 and the vertical adjustment mechanism 38 can include a screw head 150 having an axially securing slot 152 that engages the respective flange. The axially securing slot 152 substantially secures the axial position of each cooperating screw 144 to prevent movement of the cooperating screw 144 along the corresponding central axis 142 defined within the panel adjustment bracket 32. In this manner, rotation of each cooperating screw 144 maintains the axial position of each cooperating screw 144 while simultaneously providing for lateral adjustment 62 and/or vertical adjustment 64 of the panel adjustment bracket 32 within the adjustment region 50 defined in the bracket housing 44. Stated another way, threads of each cooperating screw 144 rotate in a substantially fixed axial position. In turn, each threaded aperture 140 slides laterally or vertically along the cooperating screw 144 and along each respective central axis 142 defined within the panel adjustment bracket 32. Accordingly, the panel adjustment bracket 32 is moved within the adjustment region 50 while each cooperating screw 144 maintains a generally consistent axial position with respect to the bracket housing 44. It is further contemplated that each cooperating screw 144 can extend entirely through the panel adjustment bracket 32 and be at least partially secured within an opposing flange 154 that is positioned opposite each respective flange. Accordingly, the first flange 46 can include an opposing first flange 156 that all cooperate to define the adjustment region 50 within which the panel adjustment bracket 32 can be adjusted. Alternatively, it is contemplated that the cooperating screw 144 can be positioned within the panel adjustment bracket 32, but not extend through the panel adjustment bracket 32.

As exemplified in FIGS. 5-8, it is contemplated that the first and second lateral adjustment mechanisms 34, 60 can include cooperating screws 144 that extend entirely through the first flange 46, the panel adjustment bracket 32 and the opposing first flange 156. Alternatively, the cooperating screw 144 of the vertical adjustment mechanism 38 can extend through the second flange 48 and into, but not through, the panel adjustment bracket 32.

Referring again to the various embodiments as exemplified in FIGS. 5-10, each of the first, second and third flanges 46, 48, 84 and the opposing first flange 156 of the bracket housing 44 can define a slot 170 that receives one of the cooperating screws 144 of the first and second lateral adjustment mechanisms 34, 60 and the vertical adjustment mechanism 38. It is contemplated that each cooperating screw 144 includes a screw head 150 having the axially securing slot 152 of the screw head 150. In this manner, each respective flange of the bracket housing 44 at the corresponding slot 170 is received by the axially securing slot 152 of each corresponding screw head 150. As the cooperating screw 144 is rotationally operated within the slot 170, each screw head 150 is also laterally slidable along a path 172 of the slot 170. An elongated or contoured shape of the slot 170 serves to define the path 172 of the slot 170 through which the axially securing slot 152 of the screw head 150 can travel during adjustment of the panel adjustment bracket 32 within the adjustment region 50 of the bracket housing 44. In this manner, the cooperating screw 144 is substantially free of movement, or free of movement, in an axial direction perpendicular to the path 172 of the slot 170, but is laterally slidable within the slot 170 to account for lateral, vertical and rotational adjustment 62, 64, 66 of the panel adjustment bracket 32 within the adjustment region 50 of the bracket housing 44.

By way of example, and not limitation, as the cooperating screw 144 of the vertical adjustment mechanism 38 is operated, the panel adjustment bracket 32 is vertically adjusted within the adjustment region 50. Accordingly, the screw heads 150 of the cooperating screws 144 of the first and second lateral adjustment mechanisms 34, 60 must laterally slide within the paths 172 of the corresponding slots 170 within the first flange 46 to account for the vertical movement of the panel adjustment bracket 32 within the adjustment region 50. Similarly, when the cooperating screws 144 of at least one of the first and second lateral adjustment mechanisms 34, 60 are rotated, the panel adjustment bracket 32 will either move laterally or rotationally within the adjustment region 50 and the screw head 150 of the vertical adjustment mechanism 38 is permitted to laterally slide through the corresponding slot 170 defined within the second flange 48 of the bracket housing 44 to account for the lateral and/or rotational adjustment 62, 66 of the panel adjustment bracket 32 within the adjustment region 50 of the bracket housing 44.

According to the various embodiments, because of the potential rotational movement of the panel adjustment bracket 32 within the adjustment region 50, the axially securing slot 152 may have a thickness that is greater than the thickness of the corresponding first or second flange 46, 48 within which the screw head 150 is positioned. This difference in thickness allows the screw head 150 to rotate relative to the respective first or second flange 46, 48. In this manner, the greater size of the axially securing slot 152 accounts for the rotational adjustment 66 of the screw head 150 and cooperating screw 144 within the corresponding slot 170 and the path 172 thereof within the respective flange. Thus, the cooperating screw 144 maintains its position along the central axis 142 of the threaded aperture 140 within which the cooperating screw 144 is disposed as the adjustment bracket 32 and the various threaded apertures 140 and central axes 142 are rotationally adjusted within the adjustment region 50.

Referring again to FIGS. 1-13, the panel adjustment mechanism 10 can be coupled to a door panel 16 or drawer panel 18 of the appliance 14. It is further contemplated that the panel adjustment mechanism 10 can include the panel adjustment bracket 32 that is engaged with a door panel 16 or the drawer panel 18. It is further contemplated that the panel adjustment bracket 32 can include a plurality of directional adjustment mechanisms 180, and also include the panel abutment surface 42 that receives the door panel 16 or drawer panel 18 of the appliance 14 within the various receptacles 106. It is contemplated that the plurality of directional adjustment mechanisms 180 can correspond to the first and second lateral adjustment mechanisms 34, 60, the vertical adjustment mechanism 38, and other similar directional adjustment mechanisms 180 of the panel adjustment mechanism 10. The bracket housing 44 of the panel adjustment mechanism 10 can be engaged with the cabinet 20 via the cabinet attachment portion 124 of a drawer glide 102 or door hinge 120. The bracket housing 44 defines the adjustment region 50 that receives the panel adjustment bracket 32. The plurality of directional adjustment mechanisms 180 of the panel adjustment bracket 32 engage the bracket housing 44 to allow for lateral, vertical and rotational adjustment 62, 64, 66 of the panel adjustment bracket 32 within the adjustment region 50. Operation of at least one of the plurality of directional adjustment mechanisms 180 operates the panel adjustment bracket 32 within the adjustment region 50 of the bracket housing 44 to position the panel abutment surface 42. The corresponding door panel 16 or drawer panel 18 in the aligned position 30 relative to the cabinet 20 and the other door panels 16 and drawer panels 18 of the appliance 14.

Referring again to FIGS. 4-8, it is contemplated that the panel adjustment bracket 32 can be a block 190 that includes a plurality of sides that correspond to the first, second and third sides 36, 40, 82 of the panel adjustment bracket 32. As discussed above, the first and second lateral adjustment mechanisms 34, 60 can extend from, extend through, extend into, or otherwise engage the first side of the block 190. Similarly, the vertical adjustment mechanism 38 can extend from, extend through, extend into, or otherwise engage the second side of the block 190. As discussed above, the first side can be oriented perpendicular, or substantially perpendicular, to the first side of the block 190. Accordingly, the first and second lateral adjustment mechanisms 34, 60 are substantially perpendicular to the vertical adjustment mechanism 38. The plurality of directional adjustment mechanisms 180 can also include a locking mechanism 80 that extends from the third side of the block 190, wherein the locking mechanism 80 can be oriented perpendicular to the first and second lateral adjustment mechanisms 34, 60 as well as vertical adjustment mechanism 38.

According to the various embodiments, the orientation of the locking mechanism 80 with respect to the first and second lateral adjustment mechanisms 34, 60 and the vertical adjustment mechanism 38 can vary, such that the locking mechanism 80 can be parallel with any one or more of the first and second lateral adjustment mechanisms 34, 60 and the vertical adjustment mechanism 38, or be of a non-orthogonal orientation relative to the other directional adjustment mechanisms 180.

It is also contemplated that the panel abutment surface 42 of the block 190 defined by the panel adjustment bracket 32 can be oriented substantially perpendicular to the first and second sides of the block 190.

Referring now to FIGS. 6-13, it is contemplated that the vertical adjustment mechanism 38 and the first and second lateral adjustment mechanisms 34, 60 can be defined by threaded pins 200 that extend outwardly from the block 190, and wherein corresponding nuts 202 engage each of the threaded pins 200 to selectively position each of the threaded pins 200 relative to the bracket housing 44. In such an embodiment, rotation of each of the corresponding nuts 202 serves to adjust the position of the block 190 relative to the bracket housing 44. According to the various embodiments, where the corresponding nuts 202 are adjusted on the threaded pins 200 of the plurality of directional adjustment mechanisms 180, the corresponding nuts 202 must first be loosened. Once loosened, the threaded pins 200 and corresponding nuts 202, being loose with respect to the bracket housing 44, to allow for adjustment of the position of the block 190 within the adjustment region 50. This movement allows for the lateral, vertical and rotational adjustment 62, 64, 66 that can be utilized to place the door panel 16 or drawer panel 18 in the aligned position 30 relative to the cabinet 20 of the appliance 14 and other door and drawer panels 16, 18 of the appliance 14. Once the block 190 is placed in the proper position, each of the corresponding nuts 202 can be tightened against the bracket housing 44, thereby securing the nuts 202 to the outer surface of the bracket housing 44, and also securing the position of the block 190 within the adjustment region 50.

According to the various embodiments, it is contemplated that the corresponding nuts 202 that rotationally engage each of the threaded pins 200 that extend from the various surfaces of the block 190 can include the axially securing slot 152 that receives the respective flange. In such an embodiment, the axially securing slot 152 of the corresponding nut 202 is maintained such that the nut 202 is substantially free of axial movement in a direction perpendicular to the flange in which the corresponding nut 202 is disposed. Accordingly, rotation of the corresponding nut 202 serves to slide the threaded pin 200 through the corresponding nut 202 and, in turn, adjust the position of the block 190 within the adjustment region 50 defined by the bracket housing 44. In such an embodiment, it is contemplated that the locking mechanism 80 can be defined by an opposing nut 202 that is secured to the opposing flange 154 of the bracket housing 44 once the block 190 is placed in the desired position within the adjustment region 50. Alternatively, the locking mechanism 80 can be defined by a separate locking nut 204 that substantially fixes the position of the block 190 within the adjustment region 50.

According to the various embodiments, it is contemplated that each door panel 16 and/or drawer panel 18 of the appliance 14 can include at least one bracket recess 122 that receives a portion of the block 190 and/or the panel adjustment bracket 32. In such an embodiment, it is contemplated that the bracket recess 122 can include one or more fasteners, such as screws, adhesives, interference connections, combinations thereof, and other various adjustment mechanisms that serve to secure the panel adjustment bracket 32 within the corresponding door panel 16 or drawer panel 18 through the use of the various receptacles 106. As discussed previously, the engagement between the bracket recess 122 and the panel adjustment bracket 32 can define a mechanism for providing inward/outward adjustment 128. Such inward/outward adjustment 128 can be provided by the engagement of the fasteners of the bracket recess 122 with the receptacles 106 of the panel adjustment bracket 32.

According to the various embodiments, aspects of the panel adjustment mechanism 10 can be incorporated within a door panel 16 of an appliance 14 or a drawer panel 18 of an appliance 14. Such appliances 14 within which the panel adjustment mechanism 10 can be incorporated can include, but are not limited to, refrigerators, freezers, dishwashers, laundry appliances, ovens, countertop appliances, and other similar appliances. The panel adjustment mechanism 10 can also be applied to aesthetic panels that are applied to the surface of a particular appliance 14. The various aspects of the panel adjustment mechanism 10 described herein can also apply to insulating panels having various outer finishes and an insulating material disposed therein. In such an embodiment, it is contemplated that the bracket recess 122 can extend into a portion of the panel, or can be a separate bracket attachment mechanism that is attached to a surface of the panel for the appliance 14.

Referring again to FIGS. 1-13, it is contemplated that an aspect of the panel adjustment mechanism 10 can be included within one or more hinges 120 of the door panels 16 of the appliance 14, where the hinge 120 for the door panel 16 of the appliance 14 includes a panel adjustment mechanism 10 that is attached to a bracket recess 122 defined within the door panel 16. As discussed above, the panel adjustment mechanism 10 includes a bracket housing 44 and a panel adjustment bracket 32 that is adjustable within the adjustment region 50 defined within the bracket housing 44 to achieve the aligned position 30 of the door panel 16 relative to the cabinet 20 and the other door panels 16 and drawer panels 18 of the appliance 14. In such an embodiment, the hinge 120 for the door panel 16 can include a cabinet attachment portion 124 that is affixed to a portion of the cabinet 20 to attach the door panel 16 to the cabinet 20 of the appliance 14. The hinge 120 can also include a panel attachment portion 126 that attaches the hinge 120 to the door panel 16. The panel attachment portion 126 can include an integrated housing, or can include a separate bracket housing 44 that is attached to the panel attachment portion 126 of the hinge 120.

According to the various embodiments, the panel adjustment bracket 32 is disposed within an adjustment region 50 defined by the bracket housing 44 where the panel adjustment bracket 32 includes the panel abutment surface 42 that attaches to and engages the door panel 16 and allows for adjustment of the door panel 16 relative to the bracket housing 44 to define the aligned position 30 of the door panel 16. It is contemplated that the engagement between the panel adjustment bracket 32 and the bracket recess 122 can allow for inward/outward adjustment 128 of the door panel 16 relative to the cabinet 20. Such inward/outward adjustment 128 can be provided for between engagement of the panel adjustment bracket 32 and the bracket housing 44.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions 86 provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerated appliance comprising:

an appliance cabinet defining at least one interior compartment;

a drawer having a drawer panel coupled to the appliance cabinet and slidably operable between a closed position, wherein the drawer panel engages a surface of the appliance cabinet and an open position; and left and right panel adjustment mechanisms coupled to the drawer panel, wherein the left and right panel adjustment mechanisms position the drawer panel in an aligned position relative to the appliance cabinet, each of the left and right panel adjustment mechanisms comprising:

a panel adjustment bracket having first and second lateral adjustment mechanisms extending from a first side of the panel adjustment bracket, a vertical adjustment mechanism extending from a second side of the panel adjustment bracket and a drawer panel abutment surface, wherein the drawer panel abutment surface is positioned perpendicular to the first and second sides of the panel adjustment bracket and is in engagement with the drawer panel; and a bracket housing having first and second flanges that at least partially define an adjustment region, wherein the first and second lateral adjustment mechanisms extends through the first flange and the vertical adjustment mechanism extends through the second flange, and wherein operation of at least one of the first lateral adjustment mechanism, the second lateral adjustment mechanism and the vertical adjustment mechanism moves the panel adjustment bracket between a plurality of positions within the adjustment region, wherein:

the panel adjustment brackets of each of the left and right panel adjustment mechanisms, respectively, are separately and independently operable to define lateral and rotational movement within the respective bracket housing and along a single plane, wherein the lateral and rotational movement is achieved at least through cooperative operation of each of the first and second lateral adjustment mechanisms of each panel adjustment bracket.

2. The refrigerated appliance of claim 1, wherein the panel adjustment bracket includes a locking mechanism that extends from a third side of the panel adjustment bracket, wherein the third side is oriented perpendicular with the first and second sides of the panel adjustment bracket, and wherein the locking mechanism engages a third flange of the bracket housing that is substantially parallel with the third side of the panel adjustment bracket, wherein the locking mechanism is operable between an adjustment position, wherein the panel adjustment bracket is adjustable through operation of the vertical and first and second lateral adjustment mechanisms, and a locked position, wherein the vertical and first and second lateral adjustment mechanisms are substantially inoperable.

3. The refrigerated appliance of claim 1, wherein each of the vertical adjustment mechanism and the first and second lateral adjustment mechanisms are defined by a threaded aperture, a central axis defined within the panel adjustment bracket and a cooperating screw that rotationally engages the threaded aperture along the central axis, wherein the cooperating screw extends through a respective flange of the bracket housing and is engaged therein such that the cooperating screw is free of lateral movement relative to the respective flange of the bracket housing and is rotationally operable within the respective flange of the bracket housing, wherein rotational operation of the cooperating screw adjusts the panel adjustment bracket relative to the respective flange.

4. The refrigerated appliance of claim 3, wherein the respective flange of the bracket housing defines a slot that receives the cooperating screw, wherein the cooperating screw includes a screw head defining an axially securing slot, wherein the respective flange of the bracket housing at the slot is received by the axially securing slot of the cooperating screw, wherein the cooperating screw is rotationally operable within the slot and laterally slidable along a path of the slot, and is free of movement in a direction perpendicular to the path of the slot.

5. An appliance comprising:

an appliance cabinet defining at least one interior compartment;

a door panel coupled to the appliance cabinet and operable between open and closed positions; and a panel adjustment mechanism selectively coupled to the door panel, the panel adjustment mechanism operating to position the door panel in an aligned position relative to the appliance cabinet, the panel adjustment mechanism comprising:

an adjustment bracket engaged with the door panel and having a plurality of directional adjustment mechanisms, and wherein the adjustment bracket includes a door panel engagement surface that receives the door panel; and a bracket housing engaged with the appliance cabinet and defining an adjustment region that receives the adjustment bracket, wherein the plurality of directional adjustment mechanisms of the adjustment bracket engage the bracket housing, and wherein operation of at least one of the plurality of directional adjustment mechanisms operates the adjustment bracket within the bracket housing to position the door panel engagement surface and the door panel in the aligned position, and wherein the plurality of directional adjustment mechanisms includes first and second lateral adjustment mechanisms that are positioned parallel with one another, and wherein operation of the first and second lateral adjustment mechanisms is adapted to move the adjustment bracket linearly and rotationally through a single plane when the door panel engagement surface is disengaged from the door panel.

6. The appliance of claim 5, wherein the adjustment bracket is a block defining a plurality of sides, wherein the plurality of directional adjustment mechanisms include the first and second lateral adjustment mechanisms extending from a first side of the block, a vertical adjustment mechanism extending from a second side of the block and oriented perpendicular to the first and second lateral adjustment mechanisms.

7. The appliance of claim 6, wherein the plurality of directional adjustment mechanisms includes a locking mechanism that extends from a third side of the block, wherein the locking mechanism is oriented perpendicular to the first and second lateral adjustment mechanisms and the vertical adjustment mechanism.

8. The appliance of claim 6, wherein the door panel engagement surface is oriented substantially perpendicular to the first and second sides of the block.

9. The appliance of claim 6, wherein the vertical adjustment mechanism and the first and second lateral adjustment mechanisms are threaded pins extending outward from the block and wherein corresponding nuts engage each of the threaded pins to selectively position each of the threaded pins relative to the bracket housing, and wherein rotation of each corresponding nut adjusts the position of the block relative to the bracket housing.

10. The appliance of claim 6, wherein the vertical adjustment mechanism and the first and second lateral adjustment mechanisms are cooperating screws and corresponding threaded apertures defined within the block, wherein rotation of any one of the cooperating screws operates the block relative to the bracket housing.

11. The appliance of claim 10, wherein the bracket housing defines slots that respectively engage each of the cooperating screws, wherein each corresponding cooperating screw includes a screw head defining an axially securing slot, wherein a portion of the bracket housing proximate a respective slot is received by the axially securing slot of the corresponding cooperating screw, wherein engagement of the axially securing slot and the bracket housing allows for rotational movement of the corresponding cooperating screw within the respective slot and simultaneous linear movement of the corresponding cooperating screw along the respective slot, wherein operation of each cooperating screw within the respective slot operates the adjustment bracket within the bracket housing.

12. The appliance of claim 5, wherein the door panel includes at least one bracket recess that receives a portion of the adjustment bracket.

13. A panel adjustment mechanism for a kitchen appliance, the panel adjustment mechanism comprising:

a panel adjustment bracket having first and second lateral adjustment mechanisms extending from a first side of the panel adjustment bracket, a vertical adjustment mechanism extending from a second side of the panel adjustment bracket and a door panel abutment surface, wherein the door panel abutment surface is positioned perpendicular to the first and second sides of the panel adjustment bracket and the first side is positioned perpendicular to the second side; and a bracket housing having a plurality of flanges that at least partially define an adjustment region, wherein the plurality of flanges includes first and second flanges, wherein the first and second lateral adjustment mechanisms extend through lateral adjustment slots defined in the first flange, wherein the vertical adjustment mechanism extends through a vertical adjustment slot defined within the second flange, wherein operation of at least one of the first lateral adjustment mechanism, the second lateral adjustment mechanism and the vertical adjustment mechanism moves the panel adjustment bracket between a plurality of positions within the adjustment region, and wherein operation of the first lateral adjustment mechanism through a first distance and cooperative operation of the second lateral adjustment mechanism through a second and different distance laterally and rotationally operates the panel adjustment bracket within the adjustment region and within a single vertical plane when the panel adjustment bracket is distal from a door panel.

14. The panel adjustment mechanism of claim 13, wherein the panel adjustment bracket includes a locking mechanism that extends from a portion of the panel adjustment bracket, and wherein the locking mechanism engages a portion of the bracket housing, wherein the locking mechanism is operable between an adjustment position, wherein position of the panel adjustment bracket is adjustable through operation of the vertical and first lateral adjustment mechanisms, and a locked position, wherein the vertical and first lateral adjustment mechanisms are substantially inoperable.

15. The panel adjustment mechanism of claim 14, wherein the locking mechanism extends from a third side of the panel adjustment bracket, and wherein the third side is oriented perpendicular with the first and second sides of the panel adjustment bracket, and wherein the bracket housing includes a third flange that is substantially parallel with the third side and receives the locking mechanism.

16. The panel adjustment mechanism of claim 13, wherein the bracket housing is engaged to a drawer glide, wherein the drawer glide includes a cabinet engagement flange, and wherein the panel adjustment bracket and bracket housing linearly and slidably operate relative to the cabinet engagement flange, the cabinet engagement flange configured for attachment to an appliance cabinet.

17. The panel adjustment mechanism of claim 13, wherein the vertical and first lateral adjustment mechanisms each include a cooperating screw and a corresponding threaded aperture defined within the panel adjustment bracket, wherein rotation of the cooperating screw within the corresponding threaded aperture operates the panel adjustment bracket within the adjustment region.

18. The panel adjustment mechanism of claim 17, wherein each of the first and second flanges includes a slot that receives the cooperating screw of the first lateral and vertical adjustment mechanisms, respectively, and wherein each cooperating screw includes a screw head having an axially securing slot defined therein, wherein the axially securing slot receives a portion of the bracket housing proximate the slot to axially secure the cooperating screw such that the cooperating screw is rotationally operable within the slot and linearly operable along the slot.

* * * * *